US005400615A

United States Patent [19]

Pearson

[11] Patent Number: 5,400,615

[45] Date of Patent: Mar. 28, 1995

[54] COOLING SYSTEM INCORPORATING A SECONDARY HEAT TRANSFER CIRCUIT

[75] Inventor: Stephen F. Pearson, Glasgow, Scotland

[73] Assignee: Thornliebank Industrial Estate, Glasgow, Scotland

[21] Appl. No.: 918,244

[22] Filed: Jul. 23, 1992

[51] Int. Cl.[6] ..... F25B 47/02

[52] U.S. Cl. ..... 62/277; 62/333; 62/DIG. 2

[58] Field of Search ..... 62/79, 175, 333, DIG. 2, 62/151, 80, 81, 275, 277, 278; 165/104.21, 104.22, 104.25

[56] References Cited

U.S. PATENT DOCUMENTS

| | | | |
|---|---|---|---|
| 2,434,221 | 1/1948 | Newton | 62/DIG. 2 |
| 3,683,640 | 8/1972 | Eber | 62/333 |
| 4,226,089 | 10/1980 | Barrow | 62/84 |
| 4,240,268 | 12/1980 | Yuan | 165/104.25 X |
| 4,344,296 | 8/1982 | Staples et al. | 62/333 X |
| 4,961,463 | 10/1990 | DenHartog et al. | 165/104.21 X |

FOREIGN PATENT DOCUMENTS

| | | |
|---|---|---|
| 2060153 | 4/1981 | United Kingdom . |
| 9014566 | 11/1990 | WIPO . |

*Primary Examiner*—Harry S. Tanner
*Attorney, Agent, or Firm*—Gifford, Krass, Groh, Sprinkle, Patmore, Anderson & Citkowski

[57] ABSTRACT

A refrigeration apparatus comprises a primary refrigeration circuit of the vapour compression type. Cooling is then provided at desired locations remote from the primary circuit using a secondary circuit containing carbon dioxide as a volatile secondary heat transfer substance. The carbon dioxide is liquified in secondary condenser (cooled by primary evaporator) and is circulated by circulation pump to expansion valves and cooling units at desired locations where it evaporates and provides cooling. The volume of possibly environmentally harmful refrigerant employed in the vapour compression primary circuit is minimized.

2 Claims, 1 Drawing Sheet

COOLING SYSTEM INCORPORATING A SECONDARY HEAT TRANSFER CIRCUIT

FIELD OF THE INVENTION

This invention relates to cooling methods and apparatus, and in particular to cooling systems incorporating secondary heat transferring fluids.

BACKGROUND OF THE INVENTION

The number of conventional, volatile refrigerant fluids available for use is steadily being reduced by legislation and general concerns arising from the apparent contribution to ozone layer depletion by certain widely used refrigerants; and, further, the contribution of such refrigerants to global warming due to the "greenhouse" effect.

Accordingly, there is a need to replace or reduce the use of such refrigerants with fluids which have no, or at least minimal ozone depleting potential and do not contribute unduly to the greenhouse effect.

One possible means to reduce the use of such potentially harmful refrigerants is to use a relatively small volume of volatile primary refrigerant to cool a much larger volume of secondary heat transfer liquid which may be pumped to the locations where cooling is required. In this way the total volume of refrigerant is reduced, since the distribution of cooling to the desired locations is accomplished using the secondary heat transfer liquid. This approach is commonly used in air conditioning systems which utilise water as the heat transfer liquid. Where cooling below freezing point is required, various aqueous solutions such as propylene glycol, ethylene glycol and calcium chloride brine may be employed as the secondary heat transferring liquid. At still lower temperatures, the viscosity of these aqueous solutions rises, requiring the use of liquids such as trichloroethylene. However, substances such as trichloroethylene tend to be toxic and are frequently highly corrosive.

U.S. Pat. No. 4,344,296 (Staples) discloses a two-stage refrigeration system having a primary vapour-compression refrigerant circuit, and a secondary heat transfer circuit. The secondary heat transfer circuit comprises a condenser (which is cooled by the evaporator of the primary refrigerator) and a secondary evaporator which provides cooling at a desired location. Ammonia is proposed as the refrigerant for the primary refrigeration circuit. However, ammonia is potentially hazardous. The provision of a secondary circuit allows a less toxic refrigerant to be used. Refrigerant 22 is proposed as the secondary heat transfer fluid. However, refrigerant 22 is a fluorocarbon refrigerant having some ozone-depletion and global warming potential.

U.S. Pat. No. 3,683,640 similarly provides a secondary refrigeration circuit which utilises a mixture of volatile heat transfer fluids which is cooled by an Electrolux-type primary refrigerator. A mixture of refrigerant 12 and refrigerant 13 is proposed as the volatile secondary heat transfer fluid. These refrigerants are also environmentally unacceptable fluorocarbons.

SUMMARY OF THE INVENTION

It is an object of the present invention to provide cooling through use of a secondary heat transfer system, and in particular to utilise the latent heat of a volatile environmentally-acceptable secondary heat transferring fluid to minimise the volume of fluid required to provide satisfactory cooling.

The present invention provides a cooling apparatus which comprises

- a primary refrigeration circuit;
- a secondary heat transfer circuit comprising a condenser cooled by the primary refrigeration circuit; and an evaporator for cooling a desired location;
- the secondary heat transfer circuit containing a volatile secondary heat transfer fluid which is carbon dioxide, the carbon dioxide being under pressure such that it is liquified in the secondary condenser and evaporates in the secondary evaporator.

The invention also provides a corresponding method of operating a cooling apparatus. Generally, liquid carbon dioxide under pressure is pumped by means of a circulating pump (which is not required to do work in condensing the carbon dioxide) from the secondary condenser to the secondary evaporator where the liquid $CO_2$ is passed through expansion means (such as a nozzle or capillary tube) to reduce the refrigerant pressure to the desired evaporating pressure. In the evaporator, the evaporating secondary heat transfer fluid picks up heat from the surroundings and is then returned to the secondary condenser.

In this way, the volume of primary refrigerant used may be substantially lower than that of the secondary heat transfer fluid.

Carbon dioxide, is used as the secondary heat transfer fluid. It is readily available, non-polluting, non-toxic and has minimal environmental impact in the volumes required. It is required that carbon dioxide refrigerant be circulated at a relatively high pressure; at 0° C. the saturation pressure of liquid and vapour carbon dioxide being 33.8 bar. This is above normal refrigeration system operating pressures, but well within the capabilities of conventional piping systems. A significant advantage of using a volatile substance as the secondary heat transferring fluid is that the volume of carbon dioxide required is relatively low, since heat transfer is largely by way of latent heat of evaporation. Also carbon dioxide has a relatively high latent heat. Moreover, carbon dioxide has a very low viscosity and does not freeze until below −56° C. and thus may be used in applications ranging from air conditioning (typically evaporating at −5° C. to 5° C.) to low temperatures freezing and cold storage (typically evaporating at −30° C. to −50° C.). A further advantage of using low volumes of a relatively high pressure secondary heat transfer fluid is that piping diameter requirements are reduced.

In one embodiment of the present invention the apparatus may be provided with an alternative secondary circuit for use in defrosting the secondary circuit. Waste heat may be transferred from the primary refrigeration circuit to the secondary heat transfer fluid at circulating pump pressure. The warmed vapour may be led to the cooling unit and condensed therein to melt any frost which has formed on the exterior of the secondary evaporator.

BRIEF DESCRIPTION OF THE DRAWING

These and other aspects of the present invention will now be described, by way of example, with reference to the accompanying drawing, wherein.

DETAILED DESCRIPTION OF DRAWING

Figure 1:
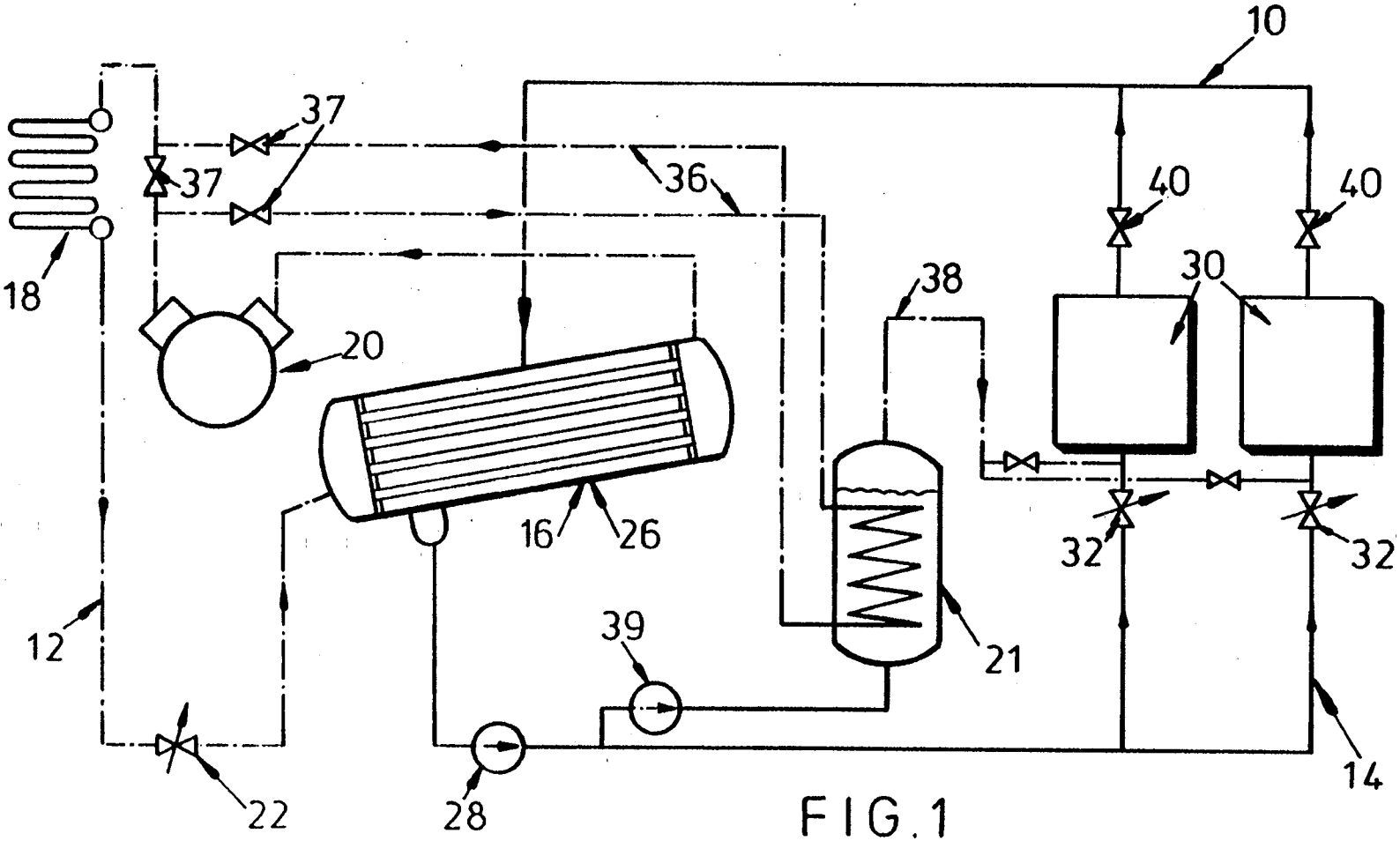
FIG. 1 is a diagrammatic representation of a cooling system in accordance with a preferred embodiment of the present invention.

The drawing shows a diagrammatic representation of a cooling system 10 in accordance with a preferred embodiment of the present invention. The system 10 includes primary and secondary refrigeration circuits 12, 14.

The primary circuit 12 (shown in dot-dash lines) includes an evaporator 16, a condenser 18, a vapour compressor 20, and an expansion device 22. The circuit 12 contains a volatile primary refrigerant of conventional composition.

In the secondary refrigeration circuit 14 (shown in solid lines), cooling of the secondary condenser 26 is provided by the primary evaporator 16. From the condenser 26 the liquified secondary heat transfer fluid is pumped, using circulating pump 28, to cooling units 30 situated where refrigeration is required. Prior to entering the cooling units 30 the secondary heat transfer fluid passes through an expansion device 32 to reduce the refrigerant pressure to the design evaporating pressure. In the cooling units 30 the evaporating heat transfer fluid picks up heat from the surroundings and then returns to the secondary condenser 26 which, as mentioned above, is refrigerated by the primary circuit 12; the secondary heat transfer fluid then recondenses. Shut-off valves 40 are provided.

The secondary heat transfer fluid is carbon dioxide under pressure, which offers numerous operating advantages. Carbon dioxide is readily available, inexpensive, non-toxic, non-polluting, is not thought to contribute to atmospheric ozone depletion and, while a recognized "greenhouse" gas, has a greenhouse effect many factors lower than conventional halo-carbon refrigerants. It is necessary that the carbon dioxide be maintained at a relatively high pressure; at 0° C. the saturation pressure of liquid and vapour carbon dioxide is 33.8 bar ($33.8\times10^5$ pascals). Such pressures are above the normal pressure range for conventional refrigerations systems but are well within the operating capabilities of conventional piping systems.

When compared to systems utilising non-volatile secondary heat transferring liquids, the mass flow of carbon dioxide required to provide the same cooling effect is substantially lower due to the high latent heat of carbon dioxide, when compared to the relatively low specific heat capacities of conventional heat transferring liquids. In addition, due to the relatively high pressures at which evaporated vapour return takes place, the dimensions of the secondary piping are substantially reduced.

It is a further advantage of using a volatile secondary refrigerant that the defrosting of cooling units 30 may be relatively easily achieved by vapourising the liquified $CO_2$ at defrost pump 39 by heat exchange with waste heat from the primary refrigeration system in a vapourizing pot 21. Such a system is indicated by the chain dotted lines 36 and 38 shown in the drawing. Line 36 indicates the primary waste heat circulating system redirected using valves 37, and line 38 indicates the alternative secondary refrigerant path, avoiding the secondary expansion device 32. The relatively warm carbon dioxide vapour is led directly to the cooling unit 30 and condensed at pressure therein to melt any frost which has formed on the outside of the unit. The valves necessary to allow pressure to build up in the cooling units and the means of releasing the condensed $CO_2$ in the cooling units down to pump suction pressure have not been shown, in the interests of clarity. However, these are standard features of refrigeration systems with hot gas defrosting and the provision of suitable apparatus will be obvious to one of skill in the art.

The above described embodiment would be very suitable for use in an air conditioning system, though because carbon dioxide has a very low viscosity and does not freeze until below −56° C., a similar system may equally well be used in low temperature applications such as in low temperature freezing and cold storage. Typically, for air conditioning applications, the $CO_2$ would be evaporated at 0° C.±2° C. at a pressure of 34.85 Bar ($34.85\times10^5$ pascals). For freezing uses, the $CO_2$ would typically be evaporated at −40° C.±2° C. at a pressure of 10.05 Bar ($10.05\times10^5$ pascals).

From the above description it will be clear that the present invention provides a relatively environmentally benign system and also offers numerous advantages over conventional secondary heat transfer systems.

It will be clear to those of skill in the art that the above described embodiment is merely exemplarly of the present invention, and that various modifications and improvements may be made to the described example without departing from the scope of the invention; the primary refrigeration circuit 12 described above is of conventional form, though it could equally well utilise a different refrigeration cycle and thus be provided with different refrigeration circuit elements.

I claim:

1. A cooling apparatus which comprises:

a primary vapour-compression refrigeration circuit including a vapour compressor, a primary condenser for receiving and cooling compressed vapour, and a primary evaporator wherein the cool compressed vapour is evaporated;

a secondary heat transfer circuit comprising a secondary condenser cooled by the primary evaporator and a secondary evaporator for cooling a desired location; and a volatile secondary heat transfer fluid which is carbon dioxide, the carbon dioxide being under pressure such that it is liquified in the secondary condenser and evaporates in the secondary evaporator;

a defrost circuit comprising a vapouriser and diverter means for diverting liquid carbon dioxide leaving the secondary condenser through the vapouriser, such that carbon dioxide vapour passes to the evaporator for defrosting thereof; and a primary waste heat circulating system for circulating compressed refrigerant vapour in the primary circuit to the vapouriser such as to provide heat thereto.

2. An apparatus according to claim 1 which further comprises circulating means for circulating liquid carbon dioxide from the secondary condenser to the secondary evaporator.

* * * * *